US005647826A

United States Patent [19]

Butler

[11] Patent Number: 5,647,826

[45] Date of Patent: Jul. 15, 1997

[54] AQUATIC EXERCISE AND REHABILITATION DEVICE

[76] Inventor: Brian R. Butler, 2727 Hillview Dr., Broomal, Pa. 19008

[21] Appl. No.: 549,027

[22] Filed: Oct. 27, 1995

[51] Int. Cl.[6] ..... A63B 21/008; A63B 22/06

[52] U.S. Cl. ..... 482/111; 482/53

[58] Field of Search ..... 482/111, 57, 51–54, 482/58, 112; 4/563.1; 119/700, 702

[56] References Cited

U.S. PATENT DOCUMENTS

| | | | |
|---|---|---|---|
| 4,163,106 | 7/1979 | Grimes et al. | 4/563.1 |
| 4,712,788 | 12/1987 | Gaundreau | 4/563.1 |
| 5,050,863 | 9/1991 | Yacoboski | 482/111 |
| 5,116,295 | 5/1992 | Dunn | 482/53 |
| 5,123,641 | 6/1992 | Abboudi et al. | 482/54 |
| 5,218,727 | 6/1993 | Krumbeck | 4/563.1 |
| 5,354,253 | 10/1994 | Awbrey et al. | 482/58 |

*Primary Examiner*—Stephen R. Crow
*Attorney, Agent, or Firm*—Connolly & Hutz

[57] ABSTRACT

An aquatic exercise and rehabilitation device includes an exercise cycle which is mounted in a tank or water holding vessel. The user would sit on a seat and the user's legs would be placed on pedals connected to the wheel. The wheel unit can be rotated from the force from the user or alternatively the rotational force could be imparted by a rotating drive surface which contacts the wheel unit. A particularly suitable form of rotating drive surface is a treadmill which optionally offers an alternative form of underwater exercise.

2 Claims, 5 Drawing Sheets

10
98
96
92
20
102
100
78
78
72
42
46
64
76
58
120
114
110
116
124
122
62
40
60
112
118
126

146
220
78
72
42
46
58
138
142
140
134
132
130
148
P
116
120
140
136
40
112
118
144

92
78
78
72
46
5
64
98
96
92
40
104
184
102
100
78
78
186
94
72
42
46
160
64
188
168
76
80
170
58
52
150
62
66
68
40
60
162
158
156
152
154
180
166
164
190
182
5

200
216
202
46
72
212
214
64
210
204
60
206
208

AQUATIC EXERCISE AND REHABILITATION DEVICE

BACKGROUND OF THE INVENTION

The aquatic exercise has been used in particular with unilaterally or bilaterally diminished mobility or range of motion of the upper or lower extremities as well as by amputees and other musculoskeletal and neurologically challenged individuals. A person, for example is substantially lighter when under water and thus able to perform exercises under water that could not be otherwise performed.

Various attempts have been made to provide aquatic exercise and rehabilitation devices. My U.S. Pat. No. 5,316,532 and my application Serial No. 236,559 filed May 2, 1994 illustrate and describe a particularly advantageous form of aquatic exercise and rehabilitation device. As described therein the device includes an exercise cycle which is mounted to a lift assembly. The cycle would in its non-use position be disposed outside of the tank or vessel so that the user could be seated on the cycle and the user's legs could be engaged with the pedals of the cycle wheel unit. The cycle can then be lifted and disposed over and then lowered within the vessel so that the cycle and most of the user's body is below water. The user is then able to perform an aquatic exercise by pedaling the cycle.

Under some conditions it is not possible or it is quite difficult for the user to impart the sufficient force necessary to effect the pedaling of the wheel unit or the manipulation of the connected handlebars. It would therefore be desirable if an independent drive force could be used for rotating the wheel unit so that the user would still have the benefit of the user's legs being moved in a rotational manner from the engagement of the user's feet with the cycle pedals while the wheel unit and pedals rotate.

SUMMARY OF THE INVENTION

An object of this invention is to provide an aquatic exercise and rehabilitation device capable of being driven either by the force from the user or by an external force.

A further object of this invention is to provide such a device wherein a form of aquatic exercise could be performed in the same vessel in addition to or instead of the cycling exercise.

A still further object of this invention is to provide a treadmill which is utilized for providing a driving force to a cycle wheel unit whether used as an aquatic exercise or a non-aquatic exercise.

In accordance with one embodiment of this invention an exercise cycle of the type disclosed in my U.S. Pat. No. 5,316,532 and application Serial No. 236,559 is optionally driven by a rotating drive surface which preferably has its drive unit mounted externally of the vessel. The drive surface could be a motor driven belt or a turbine driven belt. In a preferred practice of the invention, however the drive surface is the endless belt on a treadmill.

The treadmill may be utilized in a vessel which has a sunken end to function as a deep exercise tank. In this embodiment the treadmill could selectively be disposed in an operative condition which spans the deep end of the vessel so as to provide support and stability for the cycle in addition to providing its driving force. When it is desired to use the deep exercise tank, the treadmill could be moved to a stored condition such as being pivoted upwardly to a vertical position so as to expose the deep end of the tank.

In a further embodiment of this invention instead of using a exercise cycle of the type disclosed in my U.S. Pat. No. 5,316,532 and my application Serial No. 236,559 the exercise device may be of a stepper type. In this embodiment the user would sit on a seat connected to the lift assembly and the device would further include foot pedals which reciprocate back and forth in opposition to resistance elements similar to a conventional stepper except that the movement would be horizontally applied rather than vertically applied as with conventional steppers. If desired, handlebars could also be provided connected to the pedals so that the user's upper body strength could be utilized for effecting the reciprocating movement of the pedals similar to the provision of handlebars for the cycle.

THE DRAWINGS

DETAILED DESCRIPTION

In a preferred practice of this invention an exercise cycle is utilized which may have the form and structure described in my U.S. Pat. No. 5,316,532 and application Serial No. 236,559. The details of the aforenoted patent and application are incorporated herein by reference thereto. Accordingly, in the following description specific features of the device which is already described in the aforenoted patent and application will be referred to only as is desirable for an understanding of this invention.

Figure 1:
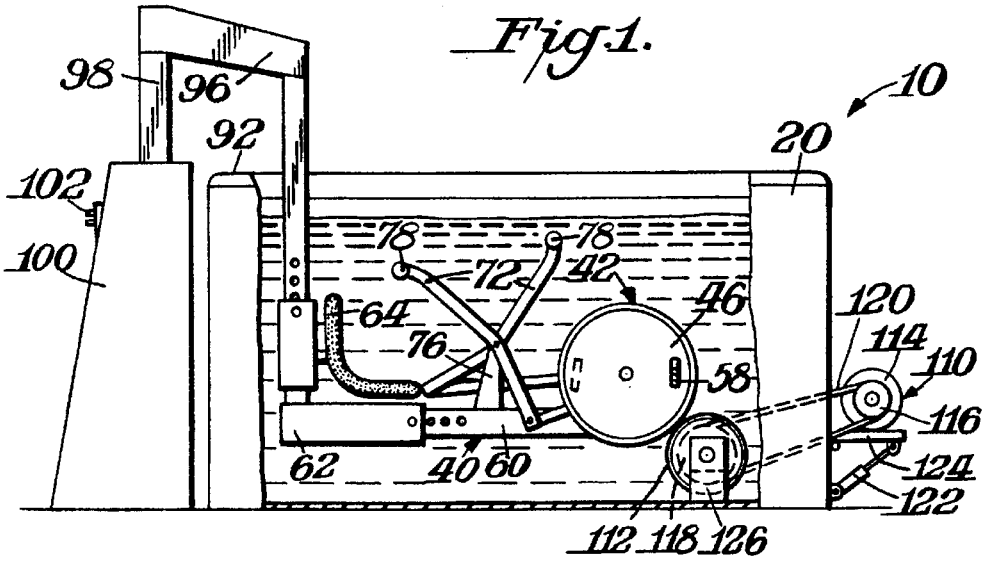
FIG. 1 is a side elevational view partly broken away showing an aquatic exercise and rehabilitation device in accordance with one embodiment of this invention.
Figure 3:
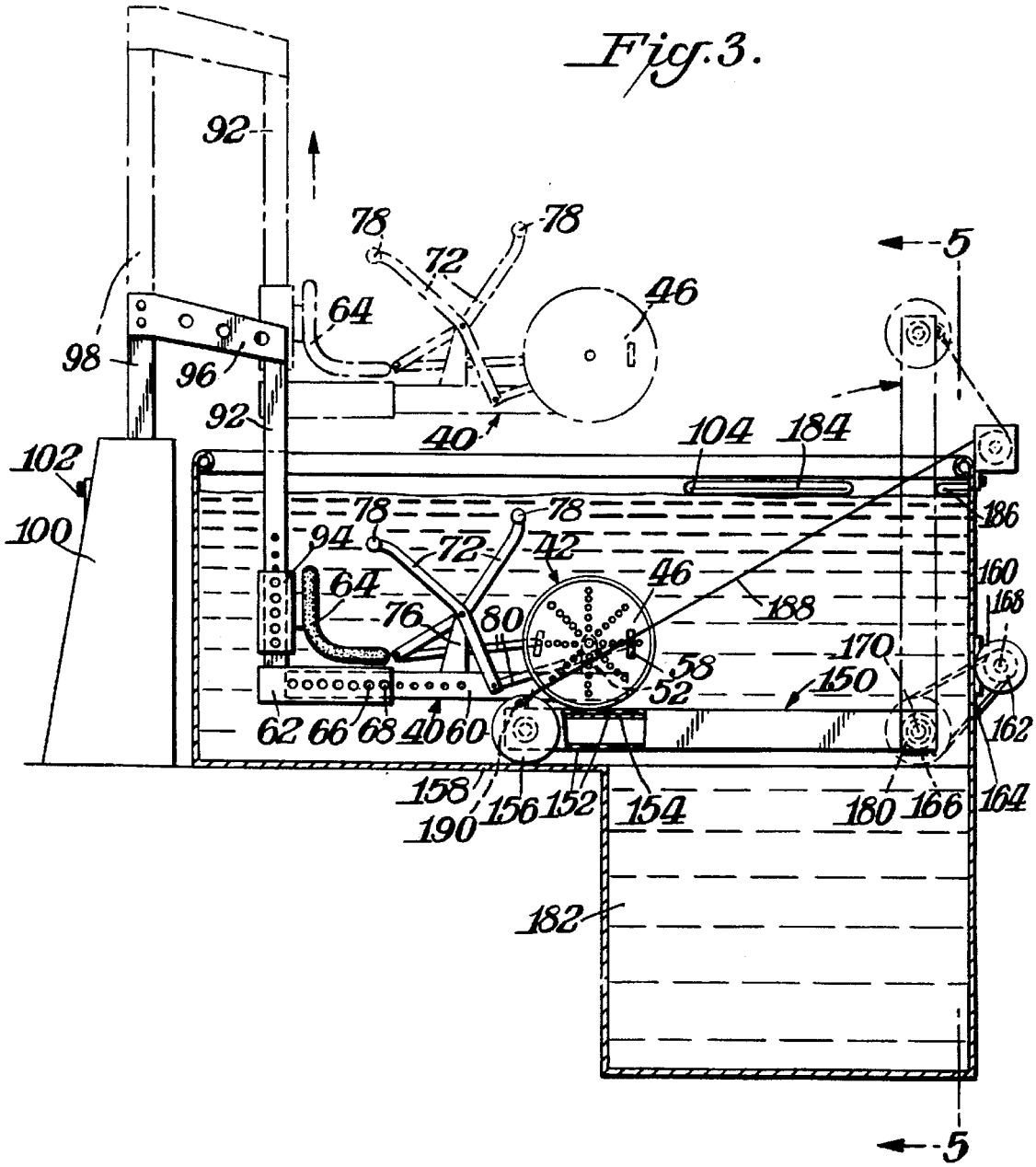
FIG. 3 is a side elevational view partially broken away showing yet another alternative form of this invention.
Figure 4:
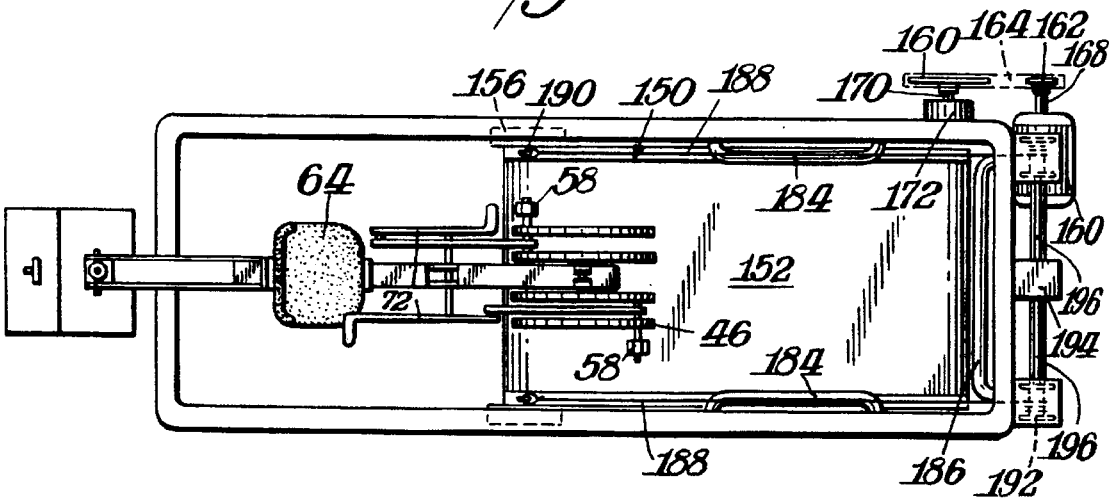
FIG. 4 is a top plan view of the device shown in FIG. 3.
Figure 5:
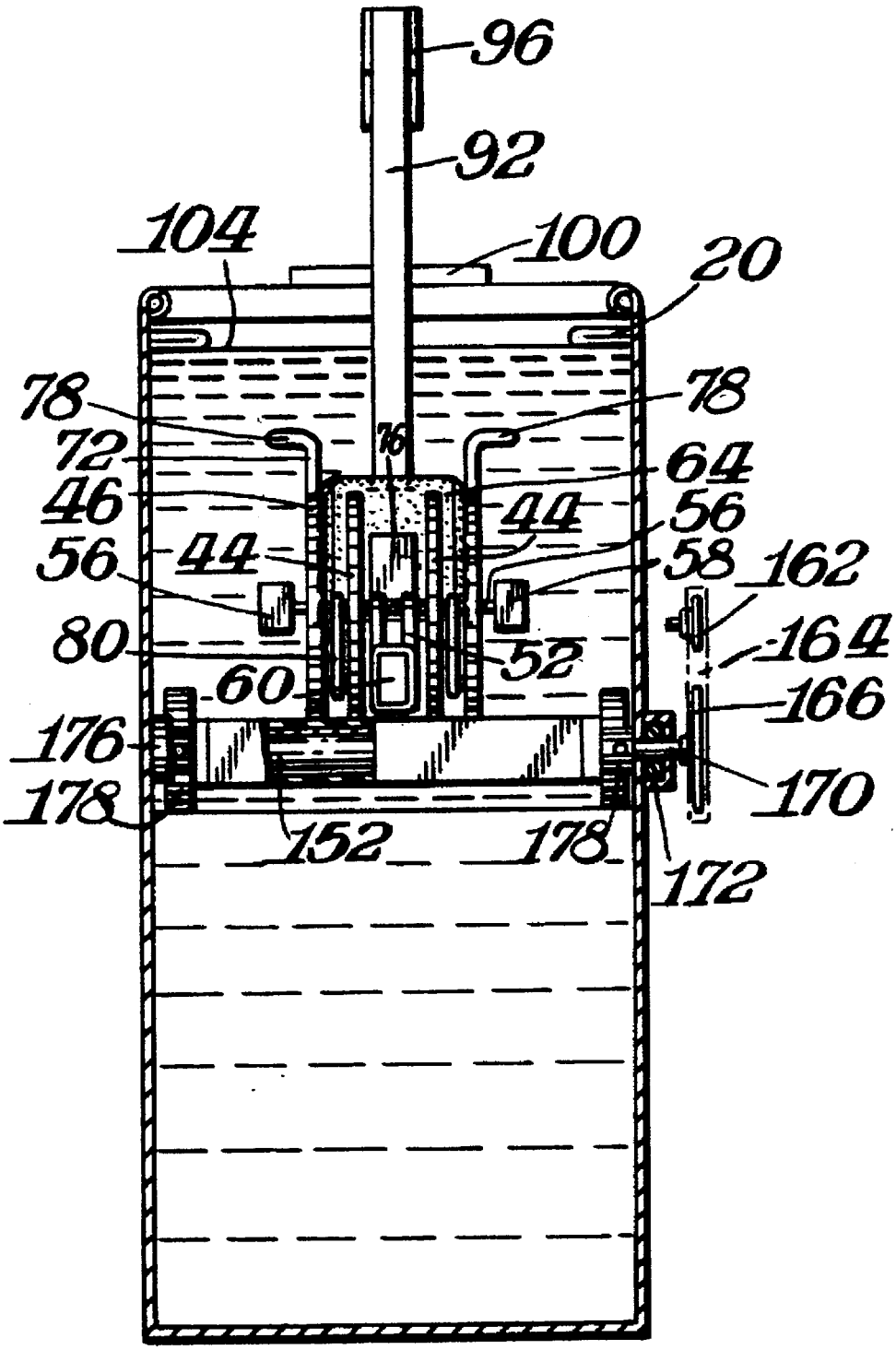
FIG. 5 is a cross-sectional view in elevation taken through FIG. 3 along the line 5—5.

FIG. 1 illustrates an aquatic exercise and rehabilitation device 10 in accordance with one embodiment of this invention. As shown therein, device 10 includes a vessel or tank 20 which would he substantially filled with water. An exercise cycle 40 is selectively mounted in vessel 20. (Details of cycle 40 are also shown in FIGS. 3–5.) Exercise cycle 40 includes a pedal assembly 42 having individual foot pedals 58 mounted to disk or wheel unit 44,46. (See also FIG. 5.) The wheel unit is vertically positioned by being mounted to upstanding forks 52. (See FIG. 3.) The cycle includes a support beam 60 which is telescopically mounted in sleeve 62 to provide adjustability in the positioning of the seat 64 from the pedals 58 in accordance with the size of the particular user. Once a proper positioning of beam 60 into sleeve 62 has been achieved, the length is fixed by the utilization of pins 68 inserted into appropriate holes 66.

If desired the free end of beam 60 may be articulated or terminate in an extension near forks 52. The extension would have a hinged connection to the beam 60 to selectively pivot the extension up or down and thereby adjust the orientation between pedals 58 and seat 64.

As also shown in FIGS. 1 and 3 handlebars 72 are pivotally mounted to upright 76 which in turn is mounted to beam 60. Each handlebar terminates in a hand grip 78. The opposite or lower ends of each handlebar 72 is pivotally connected to a link 80 which in turn is connected to a respective foot pedal 58. The foot pedals or bridges 54 in turn may be connected to disks 44 and 48 of the wheel unit at various radial distances from the axle to achieve the desired length of handlebar travel. See, also FIG. 5.

Handlebars 72 may be completely detached where an arm exercise is not desired.

Cycle 40 is selectively placed within vessel 20 or outside of vessel 20 by means of a lift assembly 100. Lift assembly 100 includes a support column 92 mounted at its lower end to sleeve 60. Chair 64 is fixedly mounted to a slidable sleeve 64 through which support column 92 is inserted. The elevation of chair 64 is selected by the fixing of sleeve 94 at the appropriate vertical distance with respect to support column 92 through the use of pins and holes. The upper end of support column 92 is mounted by a cross support 96 to lift column 98. Lift column 98 is both vertically and rotationally mounted with its movement being controlled by control panel 102 to selectively elevate or lower the lift column 98 and correspondingly elevate or lower the cycle 40. In addition, the movement of the cycle to and from the vessel is effected by the rotational mounting of lift column 104. Cycle 40 would be dimensioned so that the user's head would be above the water line 104 while substantially all of the user's body would be below the water line 104.

Lift assembly 100 may be powered by water, air or oil (hydraulic).

FIG. 1 illustrates an embodiment of the invention which is particularly desirable to assist the user in the pedaling action. In the use of the embodiment of FIG. 1 the user's feet would be placed against the pedals 58. If necessary the feet could be strapped to the pedals to assure that engagement of the feet with the pedals is maintained. If the user is unable to provide the sufficient force for activating the pedals either from the user's feet or from pushing and pulling on the handles 78 of handlebars 72 a drive force is imparted by the drive mechanism 110. Drive mechanism 110 includes a rotating drive surface in the form of a rubber tire drive wheel 112 which is disposed against the outer surface of some or all of disks 44,46. Thus when wheel 112 is rotated the contact between wheel 112 and disks 44,46 cause the disks to be rotated. Rotation of the disks in turn would cause the pedals 58 to rotate and would cause the handlebars 72 to reciprocate back and forth. As a result, the user's arms and legs would be exercised.

Rotation of wheel 112 may be accomplished in any suitable manner. In the illustrated embodiment a reversible motor 114 is mounted externally of vessel 20. Motor 114 would rotate a drive pulley 116 which is connected to driven pulley 118 by belt 120. A drive belt tensioner assembly which includes an air cylinder 122 is pivotally mounted to bracket 124 on which the motor 116 and pulley 114 are mounted. Bracket 124 is pivotally mounted to raise or lower the unit thus adjusting the tension in the drive belt 120. A relay counter 126 or pickup counter may also be provided at driven pulley 118.

In order to avoid leakage of water from vessel 20 in the area of drive mechanism 110, any suitable means may be utilized to create a seal and to protect the desired components from the water. As later described with respect to FIGS. 3–5, the driven pulley could be mounted to a shaft which extends through the vessel wall at a sealed opening.

Figure 2:
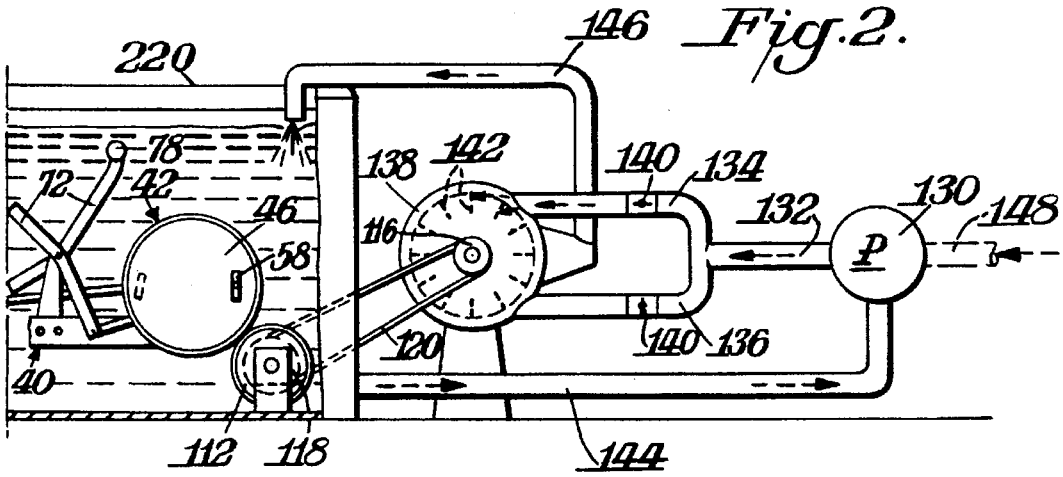
FIG. 2 is a fragmental side elevational view showing an alternative form of device shown in accordance with this invention.

FIG. 2 illustrates other manners of applying driving force to the disks 44,46. As shown therein the drive wheel 112 is driven by its coaxial connection with pulley 118 in the manner later described with respect to FIGS. 3–5 with pulley 118 in turn being driven by belt 120 mounted over drive pulley 116. Instead of using am electric motor, however, the movement is effected by means of a turbine 138. This may be accomplished by pumping water from pump 130 through passageway 132 and then either through branch 134 or branch 136 depending upon the direction of movement to be imparted to the turbine 138. Thus, a valve 140 is mounted in each branch to either open or close the flow of water through that branch. As shown in FIG. 2, valve 140 is open in branch 134 and closed in branch 136. Thus, water flows through branch 134 against the turbine vanes 142 to drive the turbine 138 and thereby also drive the coaxially mounted pulley 116. The water which flows through the system may be pumped directly from the lower portion of vessel 20 through conduit 144 and through pump 130, with the discharged water flowing through conduit 146 back into vessel 20 as illustrated in FIG. 2.

Alternatively, water may be pumped from an external source and flow through conduit 148 into pump 130. Where water is conveyed through conduit 148 it may be desirable to discharge the water into a separate vessel so as to not affect the water level in vessel 20. Alternatively, if the water level is not critical (such as when the initial level is shallow) the water may be discharged directly into vessel 20. Thus, in the embodiment shown in FIG. 2 where water is pumped through conduit 144, the level of the water in vessel 20 would remain essentially constant because the water removed is also later placed beck into vessel 20. Alternatively, where water is pumped from an external source through conduit 148 it may be desirable to discharge the water from the turbine into a separate vessel.

Although FIG. 2 illustrates the turbine 138 to be driven by water flow, it is to be understood that the turbine could also be driven by air flow.

FIG. 3 illustrates a particularly advantageous form of the invention wherein the drive force applied to the disks of the wheel unit is achieved by means of a treadmill 150. Treadmill 150 could include generally conventional structure for power operated treadmill with the necessary precautions being taken to seal various components against damage from water and to provide a sealed opening in the vessel wall where some of the drive components are located externally of vessel 20.

As shown in FIG. 3 treadmill 150 would include an endless belt 152 mounted on a foot support platform 154 with the ends of the belt disposed over rollers at each end of the treadmill 150. One end of treadmill 150 would include a weighted wheel 156 which is disposed on the floor 158 of tank or vessel 20. The wheel unit 44,46 would be disposed on the upper surface of belt 152. This could be accomplished by the utilization of lift assembly 100 to lower the cycle 40 until contact is made with belt 152. In this embodiment, as in the embodiments of FIGS. 1–2, the rotating drive surface such as wheel 112 or belt 152 supports and stabilizes cycle 40 to cooperate with the cantilevered mounting of the cycle for assuring stability.

Belt 152 is driven by having one of its rollers at the end of treadmill 150 located near the vessel wall power driven. This could be accomplished by means of a reversible drive motor 160 which drives a pulley 162 so that belt 164 in turn can drive pulley 166 in the same manner as the drive unit of FIG. 1. As later described sealed bearings would preferably be used to prevent leakage from vessel 20.

FIGS. 4–5 illustrate the drive mechanism for the treadmill. As shown therein drive motor 160 rotates its shaft 168 to rotate pulley 162 mounted on shaft 168 and thus drive belt 164 and pulley 166. All of these components are thus mounted externally of vessel 20 similar to the mounting that would be used for the drive assemblies shown in FIGS. 1 and 2. Driven pulley 166 in turn would rotate shaft 170 which extends through an O-ring water seal and bearing 172 through the vessel wall to drive a roller engaged with belt 152.

As shown in FIG. 5 shaft 170 extends through the wall of vessel 20 to drive the shaft or roller on which belt 152 is mounted and thereby drive roller 152. FIG. 5 also clearly shows how disks 44,46 contact the upper surface of belt 152 to be driven by belt 152. The opposite end of the shaft which drives belt 152 is mounted in bearing 176. Thus, the shaft coaxial with shaft 170 extends completely across the vessel 20 to mount the treadmill 150 in the vessel. The treadmill can selectively rotate upwardly about the shaft to a vertical stored condition. FIG. 5 also illustrates the inclusion of spacers 178 for treadmill 150.

As shown in FIG. 3 a quartz magnetic pickup 180 is mounted at one of treadmill 150 which is connected with the instrument panel 102 for controlling the operation of treadmill 150.

Motor 160 is preferably a reversibly driven motor to thereby control the direction of movement of disks 4,46 and handlebars 72.

In general FIGS. 1–3 involve embodiments where an external power source or drive unit drives the rotating drive member by means of a transmission assembly (e.g. pulleys, belt, shafts).

FIGS. 3 and 5 illustrate a further variation of the invention wherein the vessel 20 includes a lower end section 182 to provide a deep exercise tank. For example, a normal aquatic rehabilitation tank might be 84 inches long by 42 inches wide and 42 inches high. Where a deep exercise tank is used the recessed or deep end might be 42 inches high in addition to the 84 inches of the normal tank so that the total deep end is 42 inches deep. The tank itself could have an overall length of 10 feet.

Rails 184, 186 could be provided at the sides and end of the tank for the user to hold when exercising or standing in the deep end 182. When treadmill 150 is being utilized the treadmill 150 spans across the deep end 182 with the front wheels 186 resting on upper floor 158. Where it is desired to provide access to the deep end it is necessary to position the treadmill so that it no longer spans the deep end. FIG. 3, for example, shows in phantom the pivoting of treadmill 150 about the shaft coaxial with shaft 170 to a vertical stored condition where substantially all of the deep end 182 is thereby exposed.

Any suitable means may be utilized for achieving or raising pivotal movement of treadmill 150. FIGS. 3 and 4, for example, illustrate the utilization of a pair of cables 188 secured to eyelets 190 at the weighted end of treadmill 150. Cables 188 are mounted to reels 192 at each side of the tank 20 as best shown in FIG. 4. Reversible motor 194 rotates shafts 196 on which each reel 192 is mounted to wind or unwind the cables 188 and thereby raise or lower the treadmill. Thus when the treadmill is raised, as shown in phantom in FIG. 3, a user may stand in the deep end and hold the rails 184,186 while performing some form of exercise.

If desired, treadmill 150 alone could be used alone as an exercise device where, for example, cycle 40 is externally located of tank 20. Alternatively cycle 40 could also be disposed on or near the upper run of belt 152 but out of contact with the belt to permit use of the treadmill without driving the cycle. If desired the cycle and treadmill could be used simultaneously by two individuals. Thus, the provision of a treadmill 150 in the tank provides the user with the options of using a treadmill as an exercise device or using a treadmill to drive the cycle or pivoting the treadmill to an inactive position and using the cycle alone or pivoting the treadmill to an inactive position and using deep water tank.

In each of the prior embodiments an adjustable resistance setting unit could be engaged with the disks or handlebars to resist their motion.

The combination of a treadmill to power a cycle may also be utilized even outside a tank where it is desired to provide a drive force to a cycle or other similar exercise device.

Figure 6:
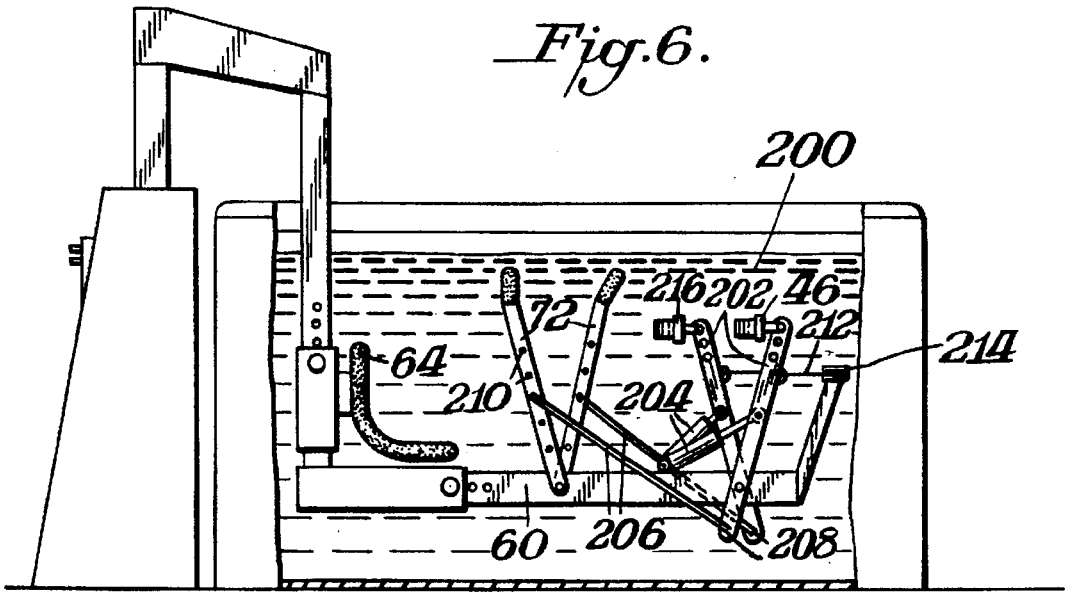
FIG. 6 is a side elevational view showing yet another embodiment of this invention.

FIG. 6 illustrates a further embodiment of this invention wherein the aquatic exercise is achieved by means of a horizontal type stepper instead of a cycle. As shown therein the same general arrangement would be used as with the cycle such as including a lift mechanism and the support members with the seat 64. The beam 60 would also include pivoted handlebars 72. Instead of having a cycle with disks, however, the remote end of beam 60 would have a stepper mechanism 200 mounted thereto. Stepper mechanism 200 could include a pair of pivoted levers 202 which are urged in a direction towards the user by resistance pistons 204 or any other suitable resistance means such as springs. Preferably the resistance means is adjustable. Resistance members 204 are connected to beam 60. A pair of cables 206 is connected at one end 208 to levers or arms 202 and at the other end to handlebars 72. The connection to handlebars 72 maybe adjustable as indicated by the connecting members or holes 210.

Arms or levers 202 are interconnected to each other by a cable 212 mounted around pulley 214. Each arm or lever 202 includes a pedal 216 against which the user would place the user's feet.

In operation the user would push against the pedals 216 to force the arms 202 to overcome the action of resistance members 204. During the resultant pivotal movement of arms 202 handlebars 72 would also be reciprocated back and forth. The reciprocal movement of the arms 202 and the handlebars 72 would result from the force imparted by the user on the handlebars and/or pedals.

It is to be understood that while the invention is primarily directed to providing aquatic therapy, various embodiments may be used without being in any water containing vessel. Thus, for example, the cycle alone could be used outside of a vessel. It is also to be understood that although the various figures show the disks 44,46 to be circular in shape, other shapes of disks may also be used. A circular shape, however, is preferred where the disks or wheel unit is to be externally driven such as by means of drive wheel 112 or treadmill belt 152.

It is also to be understood that various features described in the various embodiments may be used in other embodiments making suitable modifications where necessary. Thus, for example, the stepper embodiment of FIG. 6 could also include a treadmill in the same tank or vessel to provide an optional form of exercise. Similarly, the stepper of FIG. 6 could be used in a deep exercise tank with or without a treadmill therein.

The invention in its various embodiments particularly lends itself for use in CPM (continuous passive motion) for use at fast or slow speeds.

As can be appreciated the present invention thus provides a variety of different techniques for achieving aquatic therapy in accordance with the needs of a particular user.

What is claimed is:

1. An aquatic exercise and rehabilitation apparatus comprising a vessel for having water therein, a stepper assembly mounted in said vessel, said stepper assembly including a frame, a seat mounted to said frame, a pair of pivoted arms mounted to said frame, a pedal mounted on each of said pivoted arms, resistance members reacting between said frame and said pivoted arms, a pair of handlebars pivotally mounted to said frame, each of said handlebars being connected by a cable to a respective one of said arms whereby a handlebar and its associated arm moves jointly together, and a lift mechanism for selectively placing said stepper within and outside of said vessel.

2. The device of claim 1 wherein said lift mechanism includes structure for selectively raising and lowering said stepper assembly and for rotating said stepper assembly.

* * * * *